US005852284A

United States Patent [19]

Teder et al.

[11] Patent Number: 5,852,284

[45] Date of Patent: Dec. 22, 1998

[54] INSULATING GLASS WITH CAPACITIVELY COUPLED HEATING SYSTEM

[75] Inventors: Rein S. Teder, Bloomington, Minn.; Peter F. Gerhardinger, Toledo; Fred A. Millett, Perrysburg, both of Ohio

[73] Assignee: Libbey-Owens-Ford Co., Toledo, Ohio

[21] Appl. No.: 779,470

[22] Filed: Jan. 7, 1997

[51] Int. Cl.[6] ..... H05B 3/06

[52] U.S. Cl. ..... 219/522; 219/219; 219/542; 219/543

[58] Field of Search ..... 219/203, 219, 219/520, 522, 532, 536, 541, 542, 218, 497, 499, 510, 543; 49/70

[56] References Cited

U.S. PATENT DOCUMENTS

| | | | |
|---|---|---|---|
| 3,858,027 | 12/1974 | Phillips . | |
| 3,859,502 | 1/1975 | Heaney . | |
| 3,902,040 | 8/1975 | Ikeda et al. . | |
| 3,968,342 | 7/1976 | Inaba . | |
| 4,032,745 | 6/1977 | Roselli . | |
| 4,127,765 | 11/1978 | Heaney . | |
| 4,139,723 | 2/1979 | Havas . | |
| 4,248,015 | 2/1981 | Stromquist et al. . | |
| 4,260,876 | 4/1981 | Hochheiser . | |
| 4,277,672 | 7/1981 | Jones . | |
| 4,350,978 | 9/1982 | Riccobono . | |
| 4,356,440 | 10/1982 | Curtiss et al. . | |
| 4,408,150 | 10/1983 | Holston et al. . | |
| 4,434,358 | 2/1984 | Apfelbeck et al. . | |
| 4,713,599 | 12/1987 | Davis . | |
| 4,730,097 | 3/1988 | Campbell et al. . | |
| 4,766,366 | 8/1988 | Davis . | |
| 4,825,128 | 4/1989 | Sprengers . | |
| 4,827,729 | 5/1989 | Groth et al. . | |
| 4,835,040 | 5/1989 | Callies et al. . | |
| 5,072,098 | 12/1991 | Matthews et al. . | |
| 5,170,040 | 12/1992 | Wirtz et al. . | |
| 5,285,048 | 2/1994 | Nakase . | |
| 5,319,301 | 6/1994 | Callahan et al. . | |
| 5,365,148 | 11/1994 | Mallon et al. . | |
| 5,376,455 | 12/1994 | Hartig et al. | 428/428 |
| 5,386,195 | 1/1995 | Hayes et al. . | |
| 5,424,618 | 6/1995 | Bertenshaw et al. . | |
| 5,449,885 | 9/1995 | Vandecastele | 219/522 |

*Primary Examiner*—Tu Ba Hoang
*Attorney, Agent, or Firm*—Marshall & Melhorn

[57] ABSTRACT

A glass heating system includes a low emissivity sheet of coated glass and a capacitor for capacitive coupling the coated glass to a power source. The low emissivity glass is economical to produce and provides superior thermal properties. The low emissivity glass has a low sheet resistance and is coupled to one or more capacitors to increase the impedance of the circuit and reduce the power dissipation by the coated glass. The exact amount of power to be delivered to the coated glass can be varied by changing the capacitor. The low emissivity glass has improved thermal characteristics for use in insulating glass doors for freezers and refrigerators. In a two-paned insulating glass door, the capacitor can be conveniently mounted in the frame of the door or in the space between the two panes.

21 Claims, 3 Drawing Sheets

INSULATING GLASS WITH CAPACITIVELY COUPLED HEATING SYSTEM

BACKGROUND OF THE INVENTION

1. Field of the Invention

The present invention pertains to a heated glass system and insulating glass units, and more particularly, to a sheet of low emissivity glass with a resistive coating which is connected to a power source. A capacitor is coupled to the resistive coating to increase the impedance and control the power dissipated by the coated glass. When used in an insulating glass unit for commercial freezer and refrigeration doors, the heated glass prevents condensation from forming on the doors.

2. Summary of Related Art

Insulating glass units with electrically heated glass are used in commercial freezer and refrigeration doors to keep the doors free of frost and condensation so that customers can see the products in the freezer or refrigerator. The clear glass doors improve sales and keep the frost and condensation from damaging the goods and the cooling equipment.

In a two-paned insulating glass unit, an unexposed surface of one or both of the sheets of glass is coated with a conductive material, such as fluorine-doped tin oxide. The conductive coating is connected to an alternating current power supply by two bus bars or other electrical connectors mounted on opposite edges of the glass. As current passes through the coating, the surface of the glass is heated to insure a condensation-free surface. To stop the heat from migrating to the freezer or refrigerator cabinet, the doors are generally constructed of triple pane units for freezers and double pane units for refrigeration coolers.

Heated glass may also be used in other applications to prevent condensation, such as vending machines, bathroom mirrors, or skylights. In addition, heated glass may be used for heating surrounding space, such as window glass in architectural applications. Incubators is another application where heat may be generated while maintaining a clear viewing surface.

Sheets of glass suitable for heated applications are provided with a transparent, conductive coating on one surface. Typical transparent conductive coatings include tin oxide, indium oxide, and zinc oxide. The coating on the sheet of glass has a resistance, which is typically measured in "ohms per square," which is the resistance of a square piece of glass.

Sheet resistance in ohms per square is a well known term in the art and is used in accordance with such meaning. For a square piece of coated glass having a known sheet resistance, the resistance between opposing sides of the square piece of coated glass remains constant for any size of square. The resistance can be measured by using a 4 point probe ohmmeter or other similar measuring device.

The coated glass used in the applications noted above is often rectangular in shape. The resistance between opposing side of the rectangular piece of coated glass varies depending on the dimensions of the glass. However, once the sheet resistance in ohms per square of a specific type of coated sheet of glass is known, the resistance between opposite sides of any rectangular piece of glass can be calculated based on the actual dimensions of the rectangular sheet of glass per the following equation:

$$R_G=(d/w)\ R_S$$

where $R_G$ is the resistance of the rectangular piece of coated glass as measured between the opposing sides on which the bus bars are mounted, d is the distance between the two sides with bus bars, w is the length of the two sides on which the bus bars are mounted, and $R_S$ is the surface resistance in ohms per square of a square piece of coated glass the coated glass. The ratio of d/w is often referred to as the aspect ratio.

Assuming that the coating is applied in a uniform thickness, the resistance will be uniform across the coated glass. The resistance of the coated glass can also be changed by varying the thickness of the coating applied on the glass. For coated glass connected directly to a power supply, the power dissipation may be controlled by varying the resistance of the coated glass.

A common size for a freezer door is 6 feet by 2 feet. For such a freezer door with a coating having a resistance of 100 ohms per square, the resistance of the freezer door would be 300 ohms measured between the 2-foot sides and 33.33 ohms measured between the 6-foot sides.

The preferred power dissipation density for a freezer door in a humid environment typically ranges from 4–10 watts per square foot. The power dissipation density is reduced for less humid applications, such that the preferred range, in general, is from 1 to 10 watts per square foot. Power dissipation densities above 10 watts per square foot will not generally place undue thermal stress on the coated glass, but will result in inefficient operation of the overall cooling system. For a 2×6 freezer door with a desired power dissipation of 6 watts per square foot to heat the door, the total power dissipation for the door is 72 watts. The power dissipated by the door can be controlled by setting the voltage, current, and/or resistance in the system used to heat the door (power=$VI=I^2R_G$).

Control of the power dissipated by the freezer or refrigeration door is an important concern. If the power is too low, condensation and frost will form on the glass. If the power dissipation is too high, additional costs will be incurred. The additional energy required to heat the door is a nominal cost, but the operating costs on the cooling system to maintain the freezer or refrigerator at the desired temperature can be significant. In general, the goal is to keep the units free from frost and condensation with a low power dissipation density. Consequently, there is a need for a low cost system to maintain the power dissipation density from the coated sheet of glass at the desired power level.

One method used to control the power dissipation from the heated window was to hook the bus bars directly to a 115 volt power supply and vary the resistance of the coating. For a 2×6 door with bus bars connected to 115 volt power with dissipation density of 6 watts per square foot, the resistance of the coating on the glass door needs to be 183.7 ohms to produce the desired dissipation. If the bus bars are positioned on the short sides, the required ohms per square resistance should be 61.2. If the bus bars are positioned on the long sides of the door, the ohms per square resistance of the coating should be 551.

In the production of freezer doors and refrigerator doors for direct connection to a power supply, it is not generally possible to specify a single coating for the glass produced for the doors. Differences in glass door size, power dissipation requirements, line voltages, and mounting configurations necessitates a number of different coatings with different ohms per square resistances. Because doors required varying sheet resistances, the majority of the glass for the doors are coated in an off-line customized production process in order to provide the resistance matching requirement.

In an off-line production operation, conductive coatings of tin oxide have traditionally been applied to glass using a pyrolytic spray batch process in a re-heat furnace. The sheet resistance is selected to provide the proper power dissipation for the door size and line voltage. The pyrolytic process is well suited to provide the relatively high sheet resistance required for direct connection to a power line. The coating of glass with tin oxide in an off-line process results in high costs, poor uniformity, interference colors which degrade the appearance of the coated glass, and overspray to the opposite surface.

On the other hand, glass coated with tin oxide in a high volume, on-line production operation provides a lower cost and readily available product that has improved clarity, uniformity, and heat transfer properties. Glass producers with high volume production lines for low emissivity glass often use a coating process consisting of atmospheric chemical vapor deposition (ACVD) to produce architectural window glass. Such glass has low hemispheric emissions which improves the insulating properties of the glass. A low emissivity glass (also called low E glass) can also be manufactured by off-line batch spray and off-line vacuum coating. Pyrolytic low emissivity glass produced in an on-line process often includes one or two color suppression layers to suppress the unwanted color of sprayed tin oxide. In an on-line production process, the coating is applied while the glass is being manufactured. The coating equipment is located in the tin bath in the float glass process where the glass is formed such that the residual heat of the glass is used to facilitate the chemical reaction for the coating process.

In multi-paned insulating glass units, such as freezer doors, the glass of the insulating glass unit must be heated to eliminate condensation, but yet have good insulating properties to minimize heat transfer to the freezer cabinet. The goal is to provide a coating on the glass with a low hemispheric emissivity and with a high insulating value (R value). Uncoated glass has a hemispherical emissivity of 0.84, and freezer door must typically be triple pane units in order to minimize heat transfer into the freezer cabinet. Depending on the thickness, glass coated in an off-line process will typically have a hemispheric emissivity of between 0.4 and 0.8 while a low emissivity coated glass can achieve an improved emissivity in the range of 0.05 to 0.45.

Emissivity is a measure of both absorption and reflectance of light at given wavelengths. It is usually represented by the formula: Emissivity=1−reflectance of the coating. The term emissivity is used to refer to emissivity values measured in the infrared range by ASTM standards. Emissivity is measured using radiometric measurements and is reported as hemispherical emissivity and normal emissivity.

A triple-paned insulating glass door constructed with uncoated glass will have an insulating R value of 2.94. A triple-paned door with coated glass having an hemispheric emissivity of approximately 0.45 will have an improved R value of 3.70. Using a low emissivity glass of 0.15 emissivity would improve thermal performance such that a lower cost double paned unit could be provided for freezer doors. Such a double paned unit (0.15 emissivity, 0.5 inch air space) will have an R value of 3.33. Adding argon gas between the panes increases the R value to 4.0.

Freezer and refrigerator door manufacturers desire to use one low emissivity coated glass for all applications in order to reduce the cost of the glass and in order to improve the thermal performance. However, the low emissivity glass has low resistance such that the direct connection of the glass to a power supply will produce too great a power density. In addition, the resistance matching requirements have hampered such an application.

A variety of solutions have been proposed in the past to permit the use of low emissivity glass in heated glass applications. Transformers have been used to reduce the line voltage to heated glass, as shown in U.S. Pat. No. 4,248,015 to Stromquist et al. Transformers are an unacceptable solution because they are bulky and expensive. External ballast resistors (Also shown in '015) have been used, but these are large and generate unwanted heat. Heaney, in U.S. Pat. No. 4,127,765, teaches that several doors may be wired in series. However, this complicates the wiring of the freezer door assembly, and dictates that the total number of doors be a multiple of some integer. Other control systems are disclosed in U.S. Pat. Nos. 3,859,502; 3,902,040; 3,968,342; 4,350,978; and 4,827,729.

Transformers have also been used to overcome a problem which frequently occurs when using a coated glass with a fixed resistance directly connected to a power source. If the humidity at an installation might be higher than was expected when the system was designed, possibly due to seasonal variation, the power density of the doors might be insufficient to keep condensation from occurring. Because power density was set by a fixed sheet resistance of the glass, expensive boost transformers have been installed to increase the voltage in order to correct condensation problems.

Triacs have been used to vary the voltage applied to a heated sheet of glass, an example of which is shown in U.S. Pat. No. 4,260,876 to Hochheiser. Triac phase control circuits, however, present loads to the power line that have high peak currents and high harmonic content. It is not unusual for a supermarket to have over a hundred heated freezer doors. Were each of these doors fabricated of Low-E glass and connected to triac circuits, the resulting harmonic distortion presented to the line could cause overheating in the store's line transformer. Additionally, triac circuits cause large amounts of electromagnetic interference (EMI). Triac circuits which reduce harmonic distortion and EMI have been taught, for example, by Callahan et al. in U.S. Pat. No. 5,319,301. Such circuits, however, are complex, expensive, and of only limited effectiveness in reducing peak currents.

A variety of control systems have been developed to vary power to fixed resistive loads. In U.S. Pat. No. 4,139,723, Havas discloses a resistive furnace heater which includes a bank of capacitors, rectifies, and SCRs for controlling the power to the resistive load. U.S. Pat. No. 4,434,358 to Apelbeck teaches a control system having an array of triac switches which select among a number of capacitance values. The impedance of the selected capacitance value is used to vary the power coupled to a resistively heated aircraft window. Power delivered to the heating element is controlled by varying the amount of series capacitance in the circuit. Examples of additional control systems which vary the power delivered to a resistive load include U.S. Pat. Nos. 4,356,440; 4,408,150; 4,730,097; 5,072,098; 5,170,040; 5,365,148; and 5,424,618. Capacitive coupling to conductive thin films for such applications as discharge lamps and optical fiber is disclosed in U.S. Pat. Nos. 4,825,128 and 5,386,195.

In summary, the size, cost, complexity, and other problems of power conversion circuits has precluded the widespread use of low emissivity glass in heated insulating glass for freezer doors and other applications.

SUMMARY OF THE INVENTION

In accordance with the present invention, there is provided a glass heating system which includes a low emissivity coated glass sheet and a capacitor for capacitive coupling the coated glass to a power source. The low emissivity glass is economical to produce and provides superior thermal properties. However, the low emissivity glass has a low sheet resistance such that the direct connection of the coated glass to a standard 115 volt power supply would generate too much heat for most insulating glass applications, such as freezer doors. Coupling a capacitor into the circuit reduces the power to the coated glass. The exact amount of power to be delivered to the coated glass can be varied by changing the size of the capacitor, which is much more efficient and economical than changing the resistance on the sheets of glass.

The low emissivity glass has improved thermal characteristics, which improves the efficiency of a freezer or refrigeration insulating glass unit with heated glass system. The improved thermal characteristics permits the use of double paned doors instead of triple-paned doors in many applications for insulating glass units.

In a two-paned insulating glass unit for a freezer door, the capacitor can be conveniently mounted in the frame of the door or in the space between the two panes. The capacitor can be mounted on a small circuit board, which is very inexpensive to manufacture and install in the door.

In order to provide field adjustment of the power delivered to the heated glass, two or more capacitors can be mounted on the circuit board. The capacitors can be controlled by a manual switch mounted in the door such that individual capacitors can be connected in the power circuit or multiple capacitors in parallel or series connection can be connected to vary the power to the coating on the glass. The use of a simple capacitor circuit to control the power results in a power control device that is small in size, efficient, and reliable with no EMI or induced harmonic distortion.

An object of the present invention is to use low emissivity glass for an insulating glass unit. Such glass has low resistance and good thermal properties for the insulating glass applications. The low emissivity glass can be produced on a production line for relatively low cost.

An further object of the present invention is to develop a low cost control circuit to provide the desired power dissipation for the heated glass. A direct connection of the coated surface of the glass to a power supply produces too much power dissipation. Changing the resistance of the coating for each application is too expensive for both glass manufacturing and for insulating glass unit manufacturing. Coupling one or more capacitors to the coating increases the impedance of the circuit to reduce the current flow through the coating on the surface of the glass sheet.

Another object of the present invention is to conveniently mount the capacitors in an insulating glass unit. A small circuit board can be mounted in the frame of an insulating glass unit. Capacitors and switching controls can be mounted on the circuit board.

A further object of the present invention is to eliminate the problems of electromagnetic interference and harmonic distortion which occur in triac control circuits. The capacitor control circuit of the present invention does not result in any induced harmonic distortion or electromagnetic interference.

The combination of the low emissivity glass and the simple capacitor control circuit provides a low cost and efficient heated glass unit for use on insulating glass units, such as freezer and refrigerator doors, and other heated glass applications.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
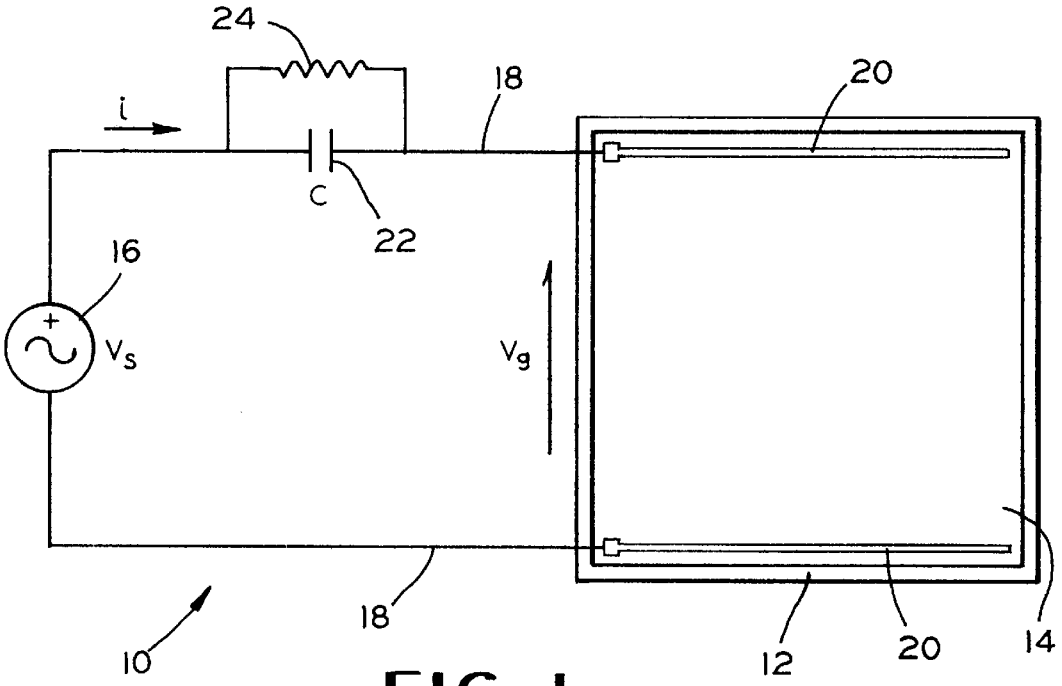
FIG. 1 is a circuit diagram of the heated glass system of the present invention.

Referring now to FIG. 1, the heated glass system 10 of the present invention is shown in schematic form. A sheet of glass 12 is coated with a microscopically thin coating of a transparent, conductive material 14. The coating material 14 may be tin oxide, indium tin oxide, zinc oxide, or other similar coating. The coating may be fabricated in a production line using a pyrolytic process, such as atmospheric chemical vapor deposition, or some alternative process. The glass 12 may also include a color suppression layer (not shown) which is applied in a similar manner.

The coating 14 reduces the emissivity of the glass 12 from approximately 0.84 to less than 0.50. The preferred range for the hemispheric emissivity is 0.15 to 0.43 for pyrolytic low emissivity glass. Other processes can be used to provide a low emissivity glass with hemispheric emissivity as low 0.01. The sheet resistance of such a conductive coating for low emissivity glass is typically less than 20 ohms per square. The low emissivity glass can be produced cost effectively on a high volume production line and provides improved thermal properties.

However, the low sheet resistance prevents direct connection of the low emissivity glass 12 to the power source 16. The power source 16 is a single phase supply and in the U.S. is rated at 60 hertz and 115 volts. At a sheet resistance of 11 ohms per square, for example, a direct coupling to a 2×6 door connected for maximum resistance of 33 ohms provides 400 watts of power or 33.3 watts per square foot. Such power dissipation density is too high for freezer and refrigerator door applications.

The electric power is supplied from the power source 16 through lead 18 to the bus bars 20. The bus bars 20 are attached to the coating 14 to ensure electrical contact between the bus bars 20 and the coating 14. The bus bars 20, which are also frequently referred to as strip electrodes, are preferably positioned along opposite edges of the glass 12 such that current flows across the coating 14 between the bus bars 20 to provide for the desired power dissipation in the form of heat.

In order to reduce the power dissipation of the coating 14 on glass 12, a capacitor 22 is connected in series with the bus bars 20. A bleed down resistor 24 is connected in parallel with the capacitor 22 to prevent a voltage build up across the capacitor. The value of the bleed down resistor 24 is quite large compared to the reactance of the capacitor and the sheet resistance of the glass 12.

Vector analysis is used to determine the value of the current (i) based on the impedance (Z) of the circuit and the phase angle (θ) of the power source voltage and the current. In a resistive load, the current and voltage are in phase. The voltage across a capacitor lags the current by 90 degrees. The voltage drop ($v_G$) across the resistive load ($R_G$) of the coating 14 on the glass 12 and the voltage drop ($v_C$) across the capacitive load ($X_C$=capacitive reactance) of the capacitor (C) 22 is as follows:

$$v_G=(i)R_G$$

$$v_C=(i)X_C=(i)\div(\omega C)=(i)\div(2\pi fC)$$

Figure 7:
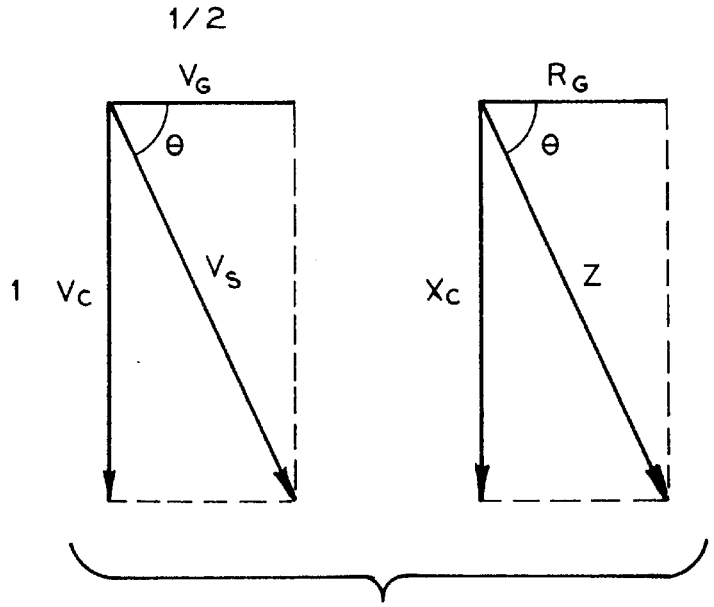
FIG. 7 is a vector diagram of the voltages and impedance of a circuit.

In the above equations, ω is the angular velocity of the power source voltage and f is the frequency of the power source voltage. FIG. 7 shows vector diagrams for the voltage vectors and the impedance vectors of a circuit in which a Pythagorean solution can be used to calculate the source voltage ($v_S$), the impedance (Z), and the current (i) in the circuit as follows:

$$v_S^2=v_G^2+v_C^2$$

$$Z^2=R_G^2+X_c^2=R_G^2+(-1\div\omega C)^2$$

$$v_S=(i)Z=(i)(R_G^2+(-1\div\omega C)^2)^{0.5}$$

$$(i)=V_S\div(R_G^2+(-1\div\omega C)^2)^{0.5}$$

The calculation for the phase angle is as follows:

$$\text{Tan }(\theta)=v_C\div v_G=X_C\div R_G=(-1\div\omega C)\div R_G$$

With current (I) flowing through the coating 14 on glass 12, the power dissipation is equal to the following:

$$P_G=v_G\ (i)=(i)^2\ R_G$$

For most store applications in the U.S., the typical power supply is 60 hertz, 115 volt. For a 2×6 sheet of low emissivity glass with a sheet resistance of 11 ohms per square with bus bars connected to provide 33 ohms resistance for $R_G$, and a capacitor of 37 microfarads, the current in the system is 1.46 amps at a phase angle of 65 degrees. The power dissipated in this example is 70.3 watts over a surface area of 12 square feet. The resulting power density is 5.8 watts per square foot, which is in the preferred power density range of 4–8 watts per square foot for a humid application. The voltage drop across the coating 14 on the glass 12 is 48 volts and the voltage drop across the capacitor 22 is 104 at a phase angle of 65 degrees.

The capacitive reactance of the present system 10 also provides benefit from a power factor standpoint. In most locations where heated glass systems are used, such as super markets, the load on the power system will have a high inductive reactance because of the induction motors used to operate compressors and fans. Power companies have certain power factor requirements and may often penalize customers with large inductive loads by charging a higher rate or requiring the customer to install power factor correction capacitors. The capacitive load in the present invention is beneficial in canceling the effects of an inductive load. In situations where the capacitive nature of the invention would be undesirable, an inductor may be placed in parallel with the capacitor 22 to cancel the capacitive effect.

Figure 2:
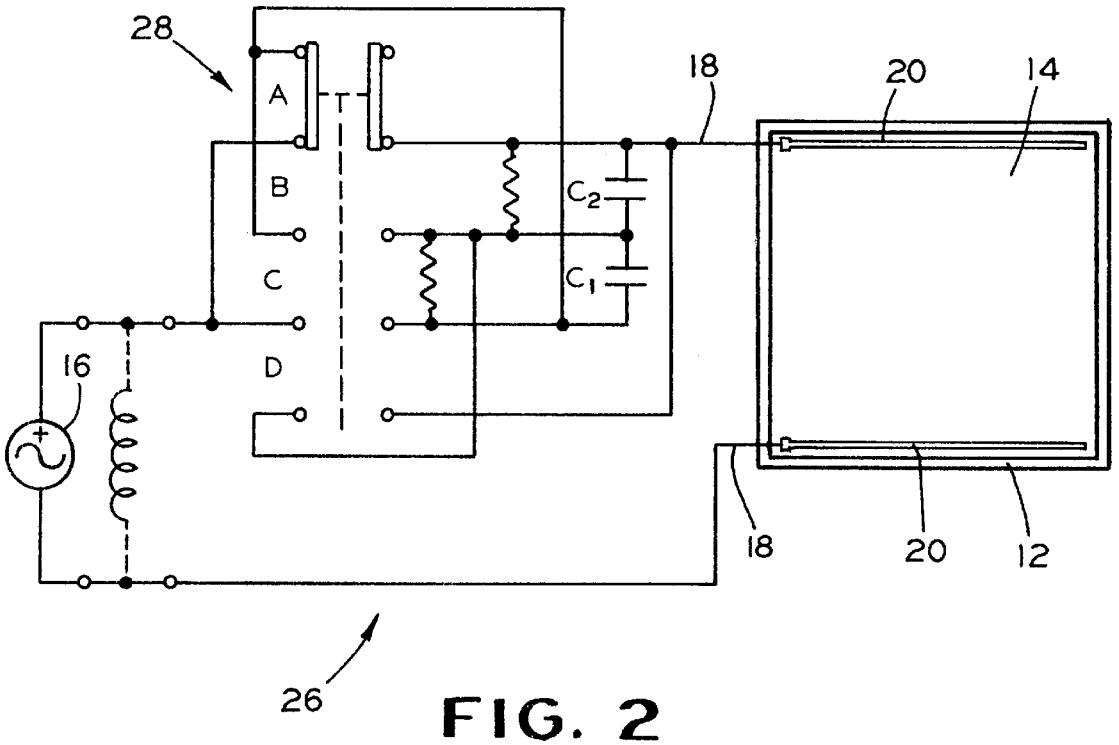
FIG. 2 is a circuit diagram of a heated glass system with two capacitors and a four position switch.
Figure 3:
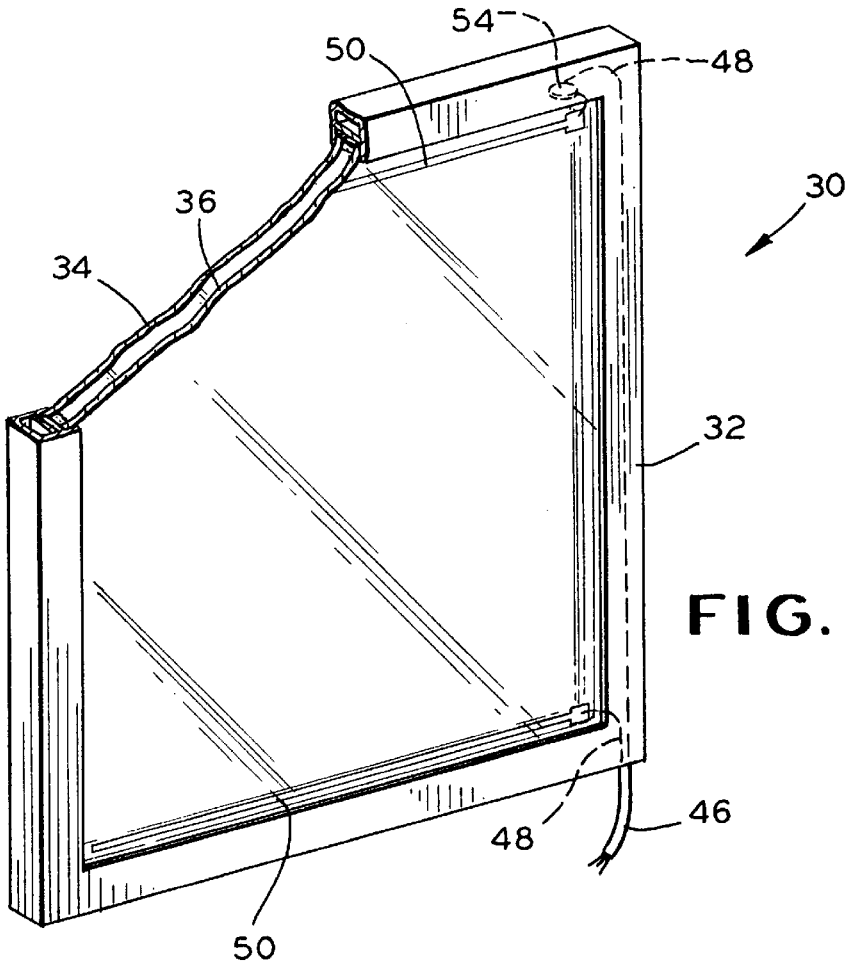
FIG. 3 is a perspective view of an insulating glass unit with a frame and two sheets of glass.

The use of a plurality of capacitors in the circuit of the present system facilitates the adjustment of the power density and the use of alternative power supplies. FIG. 2 shows an adjustable system 26 which includes a four position power switch 28 with two capacitors C1 and C2. When the power switch 28 is set at position A, capacitors C1 and C2 are connected in series. Position B provides for C2 only in the circuit and position C result in C1 only in the circuit. When the power switch 28 is in position D, the capacitors C1 and C2 are connected in series.

In a circuit with the same 2×6 coated glass 12 discussed above (33 ohms resistance) combined with the two capacitors (C1=15 μF, C2=22 μF) and power switch 28 as shown in FIG. 2, the power density for two of the most common power sources are as follows:

| | | Power Density | |
|---|---|---|---|
| Switch Pos. | Coup. Cap. Val. [μF] | at 115 V/60 Hz [W/sq. ft.] | at 220 V/50 Hz [W/sq. ft.] |
| A | 8.9 | 0.4 | 1.0 -dry |
| B | 15 | 1.1 -dry | 2.9 -normal |
| C | 22 | 2.3 -normal | 6.0 -humid |
| D | 37 | 5.8 -humid | 15.7 |

The adjustable system 26 in FIG. 2 permits a manufacturer of freezer and refrigerator doors to make a single door that operates in the desired range for power supplies in the United States and Europe. The capability of providing different power density levels for each power source facilitates the operation of the door under dry, normal, and humid conditions. The ability to build one system for both power supplies provides significant cost savings from an inventory and production standpoint.

In addition to the manufacturing cost savings, the adjustable system 26 permits changes to be made in the field after installation. The setting of the switch 28 in the adjustable system 26 could be changed to accommodate for seasonal changes or changes in the store environment.

The configuration of coupling capacitors and switch setting could be further extended to provide additional settings. Different coupling capacitors may be selected by an external switch or control circuit to vary the capacitance in the circuit and the resulting power density. The switching my be actuated in response to an automated control system responsive to relative humidity, temperature, and other sensor inputs.

The heated glass systems 10,26 of the present invention can be used in a variety of applications. One of the preferred applications is an insulated glass unit 30 for freezer doors and refrigerator doors, as shown in FIGS. 3–6. The insulated glass unit 30 includes a frame 32 and two sheets of glass, a uncoated piece 34 and a coated piece 36 having a conductive coating 38 as described above. The sheets of glass 34,36 are installed in the frame 32 in a known manner for insulated glass doors. The frame 32 is made from extruded aluminum or other similar frame material.

The sheets of glass 34,36 are held apart by a spacer 40 and sealed to form an insulated glass unit 30. The space 52 between the two sheets of glass may be filled with argon gas or other transparent gases to increase the insulating value of the unit.

If the insulating glass unit 30 is used for freezer door applications, the uncoated glass 34 would be on the inside (facing the freezer) and the coated glass 36 would form the outer surface (facing the store). The coating 38 would be applied to the unexposed surface 42 of the coated glass 36.

Figure 5:
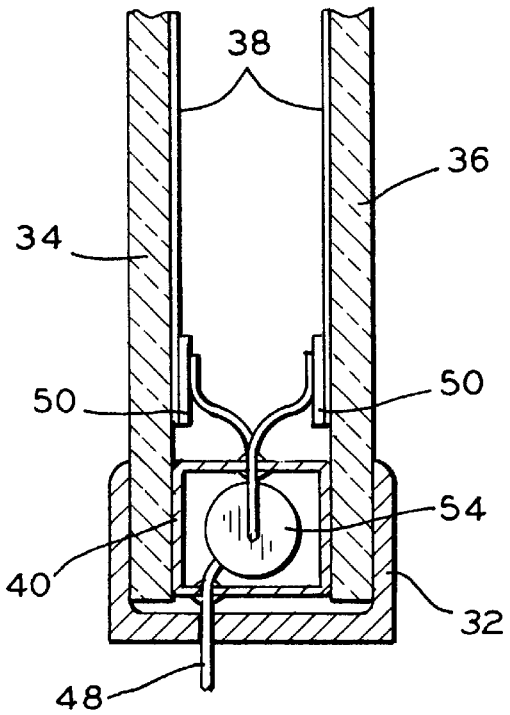
FIG. 5 is a sectional view of an alternative capacitor mounting in the spacer with a coating provided on both sheets of glass.
Figure 6:
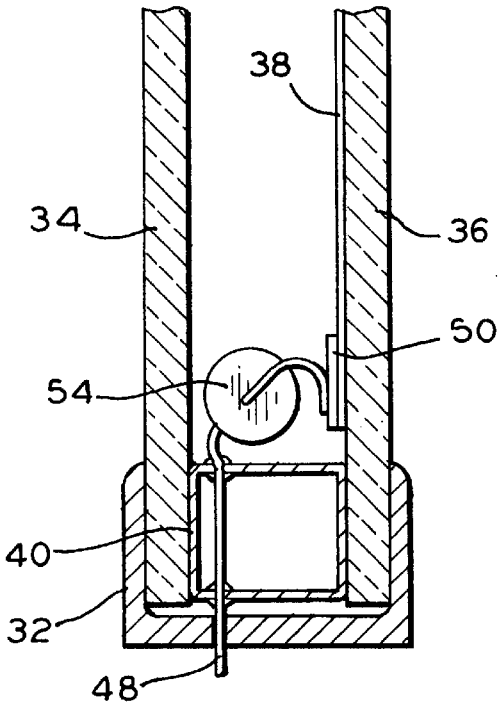
FIG. 6 is a sectional view of an alternative capacitor mounting above the spacer in the space between the two sheets of glass.

In some cases, as shown in FIG. 5, it may be desirable to heat both unexposed surfaces 42,44 of the two sheets of glass 34,36. The resistance of the coating 38 on the two unexposed surfaces 42,44 would typically be wired for parallel connection of the two surfaces such that the calculations for the current passing through the coating 14 and the resulting power dissipation would be based on parallel resistances $R_{G1}$, and $R_{G2}$. The two coated surfaces could also be connected in series in a known manner.

A grounded power cord 46 is used to convey power to the insulated glass unit 30. The two insulated leads 48 from the power cord 46 are connected to bus bars 50 at opposite ends of the glass 36. The bus bars 50 are attached to the coating 38 to ensure electrical contact between the bus bars 50 and the coating 38. The power cord 46 is connected to the insulated glass unit 30 at one end of the frame 32 in a known manner. The lead 48 electrically connected to the bus bar 50 at the opposite end of the frame 32 is secured in the frame 32 and extends along the edge of the sheets of glass 34,36.

Figure 4:
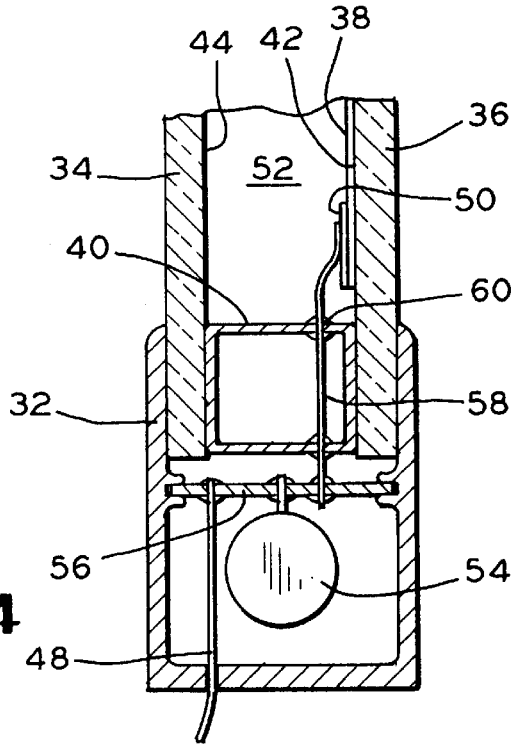
FIG. 4 is a sectional view taken substantially along line 4—4 of FIG. 3 showing the mounting of the capacitor on a circuit board in the frame of the insulating glass unit.

In FIG. 4, one or more capacitors 54 are mounted on a circuit board, and the circuit board is secured in the frame 32. Switches or other components may also be mounted on the circuit board 56. A lead 48 from the power cord 46 supplies power to the capacitors and other components mounted on the circuit board 56. A short lead 58 extends from the circuit board 56 to the terminal of the bus bar 50. The circuit board 56 and capacitors may be mounted at either end of the insulated glass unit 30.

In alternative mountings, the capacitors may be mounted in the spacer 40 of the insulated glass unit 30, as shown in FIG. 5. Such a configuration reduces the overall length of the unit. In addition, one or more capacitors 56 can be mounted in the space 52 between the sheets of glass 34,36.

In order to achieve the desired thermal insulating properties, argon or other gases may be used in the space 52 between the sheets of glass 34,36. The gaps 60 in and about the spacer 40 are covered with a sealant to properly seal the internal space 50 within the insulated glass unit 30.

The lower the hemispheric emissivity of the coated glass 36, the better the insulating value (R value) of the insulated glass unit 30. Low emissivity glass provides a benefit of better insulating characteristics. The preferred hemispheric emissivity is below 0.50. The pyrolytic low emissivity glass, which is suitable for on-line production, can achieve hemispheric emissivity in the range of 0.10 to 0.20. Pyrolytic low emissivity glass is preferred because of the low cost of production. Other low emissivity glass, such as sputter-coated multilayered glass, can be used to achieve hemispheric emissivity below 0.10. Any low emissivity glass can be used in the insulating glass unit 30 of the present invention. Because of the lower emissivity and the resulting improvement in the insulating capabilities, a two-paned insulating glass unit 30 can achieve comparable insulating values for a triple-paned door without low emissivity glass. The two-paned door of the present invention will typically provide significant cost and weight savings when compared to a triple-paned door.

With low emissivity glass directly connected to a power source, the sheet resistance is unacceptably low. This low resistance results in a current level and heat dissipation in the coated surface 38 which is too high for use in freezer or refrigerator doors. By adding capacitive reactance to increase the overall impedance of the circuit, the current through the coating 38 and the resulting power dissipation is reduced to acceptable levels. The preferred power dissipation density for freezer and refrigerator doors is in the range between 1 to 10 watts per square foot.

The heated glass systems 10,26 and the insulating glass unit 30 of the present invention permits the use of low emissivity glass, including pyrolytic low emissivity glass. The use of such glass provides a number of advantages, including low cost, improved thermal performance, improved coating uniformity, and good product appearance. Increasing the impedance of the circuit by adding one or more capacitors to the circuit provides a low cost and efficient means of adapting and adjusting the heated glass systems and insulating glass units for different power sources and different power dissipation requirements. Adding capacitive reactance to the circuit cancels the undesirable power factor effects caused by the use of induction motors and devices in the cooling operation. Power cost savings may be realized by power factor improvement resulting from the addition of capacitors to the power circuit of the present invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A heated glass system for heating glass sheet surfaces, said heated glass system comprising:

a sheet of glass having a generally rectangular shaped configuration;

a transparent, conductive coating applied to a surface of said sheet of glass, said coating having a hemispheric emissivity of less than 0.50;

a pair of bus bars mounted along opposite edges of said sheet of glass and electrically connected to said conductive coating, said bus bars each including a connector for connecting said bus bar to an alternating current power supply to form a circuit through said conductive coating; and a capacitor connected in series between one of said bus bars and the power supply, said capacitor increasing an impedance of the circuit to reduce current flowing through and to reduce power dissipated by said conductive coating.

2. The heated glass system defined in claim 1, wherein said conductive coating is tin oxide.

3. The heated glass system defined in claim 1, wherein said conductive coating is indium tin oxide.

4. The heated glass system defined in claim 1, wherein said conductive coating is zinc oxide.

5. The heated glass system defined in claim 1, including at least one additional capacitor selectively connected into the circuit between one of said bus bars and the power supply, and including a control device for controlling the connection of at least one of said capacitor and said at least one additional capacitor into the circuit to change the impedance of the circuit.

6. The heated glass system defined in claim 5, wherein the control device is a switch for changing the connections of said capacitor and said at least one additional capacitor between one of an individual, parallel, and series connection in the circuit.

7. The heated glass system defined in claim 1, wherein said conductive coating has a hemispheric emissivity in the range from 0.15 to 0.43.

8. The heated glass system defined in claim 7, wherein said conductive coating is a pyrolytic low emissivity coating.

9. An insulating glass unit comprising:

a first sheet of glass and a second sheet of glass, each sheet of glass including an unexposed surface and an outer surface;

a conductive coating applied to the unexposed surface of said first sheet of glass, said conductive coating having a hemispheric emissivity of less than 0.50;

a frame secured around a periphery of said first and second sheets of glass for maintaining the glass sheets in parallel, spaced-apart relationship with the unexposed surfaces facing each other;

a pair of bus bars mounted along opposite edges on the unexposed surface of said first sheet of glass and electrically connected to said conductive coating, said bus bars each including a connector for connecting said bus bar to an alternating current power supply to form a circuit through said conductive coating; and a capacitor mounted on said frame and connected in series between one of said bus bars and the power supply, said capacitor increasing an impedance of the circuit to reduce current flowing through and to reduce power dissipated by said conductive coating.

10. The heated glass system defined in claim 9, including at least one additional capacitor selectively connected into the circuit between one of said bus bars and the power supply, and including a control device for controlling the connection of at least one of said capacitor and said at least one additional capacitor into the circuit to change the impedance of the circuit.

11. The heated glass system defined in claim 10, wherein the control device is a switch for changing the connections of said capacitor and said at least one additional capacitor between one of an individual, parallel, and series connection in the circuit.

12. The insulating glass unit defined in claim 9, wherein said conductive coating has a hemispheric emissivity in the range from 0.15 to 0.43.

13. The insulating glass unit defined in claim 9, wherein said conductive coating is a pyrolytic low emissivity coating.

14. The insulating glass unit defined in claim 9, wherein said capacitor is mounted on a circuit board and the circuit board is positioned in said frame.

15. The insulating glass unit defined in claim 9, wherein said frame includes a spacer positioned between said first and second sheets of glass at the periphery of said sheets of glass, said capacitor being mounted within a space inside the spacer.

16. The insulating glass unit defined in claim 9, wherein said frame includes a spacer positioned between said first and second sheets of glass at the periphery of said sheets of glass, said capacitor being mounted on said spacer in a space between the unexposed surfaces of said first and second sheets of glass.

17. The insulating glass unit defined in claim 9, including a conductive coating applied to the unexposed surface of said second sheet of glass, said conductive coating having a hemispheric emissivity of less than 0.50, and including a pair of bus bars mounted along opposite edges on the unexposed surface of said second sheet of glass and electrically connected to said conductive coating, said bus bars each including a connector for connecting said bus bar to an alternating current power supply to form a circuit through said conductive coating and wherein said bus bars on said first sheet of glass and said bus bars on said second sheet of glass are connected to said capacitor.

18. A refrigerated cabinet door adapted to be movably mounted on a refrigerated cabinet, said door comprising:

a first sheet of glass adapted to be positioned adjacent the ambient environment of the refrigerated cabinet and a second sheet of glass adapted to be positioned adjacent the interior of the refrigerated cabinet, each sheet of glass including an unexposed surface and an outer surface;

a conductive coating applied to the unexposed surface of said first sheet of glass, said conductive coating having a hemispheric emissivity of less than 0.50;

a frame secured around a periphery of said first and second sheets of glass for maintaining the glass sheets in parallel, spaced-apart relationship with the unexposed surfaces facing each other;

a pair of bus bars mounted along opposite edges on the unexposed surface of said first sheet of glass and electrically connected to said conductive coating, said bus bars each including a connector for connecting said bus bar to an alternating current power supply to form a circuit through said conductive coating; and a capacitor mounted on said frame and connected in series between one of said bus bars and the power supply, said capacitor increasing an impedance of the circuit to reduce current flowing through and to reduce power dissipated by said conductive coating.

19. The heated glass system defined in claim 18, including at least one additional capacitor mounted on said frame and selectively connected into the circuit between one of said bus bars and the power supply, and including a control device for controlling the connection of at least one of said capacitor and said at least one additional capacitor into the circuit to change the impedance of the circuit.

20. The insulating glass unit defined in claim 18, wherein said conductive coating has a hemispheric emissivity in the range from 0.15 to 0.43.

21. The insulating glass unit defined in claim 18, including a conductive coating applied to the unexposed surface of said second sheet of glass, said conductive coating having a hemispheric emissivity of less than 0.50, and including a pair of bus bars mounted along opposite edges on the unexposed surface of said second sheet of glass and electrically connected to said conductive coating, said bus bars each including a connector for connecting said bus bar to an alternating current power supply to form a circuit through said conductive coating and wherein said bus bars on said first sheet of glass and said bus bars on said second sheet of glass are connected to said capacitor.

* * * * *